United States Patent [19]

Boschet

[11] 4,120,263

[45] Oct. 17, 1978

[54] MATRIX SUPPORTING DEVICES IN ELECTROSTATIC DEVELOPMENT APPARATUS

[75] Inventor: Vittorino Boschet, Milan, Italy

[73] Assignee: Grafosol S.p.A., Milan, Italy

[21] Appl. No.: 769,866

[22] Filed: Feb. 18, 1977

[30] Foreign Application Priority Data

Feb. 26, 1976 [IT] Italy ..... 20602 A/76

[51] Int. Cl.[2] ..... G03G 15/09

[52] U.S. Cl. ..... 118/657; 118/231; 118/503; 271/277

[58] Field of Search ..... 355/3 DD; 118/657, 644, 118/231, 503; 271/277; 101/132.5; 427/14, 18

[56] References Cited

U.S. PATENT DOCUMENTS

| | | | |
|---|---|---|---|
| 3,612,682 | 10/1971 | Shelffo | 355/3 DD X |
| 3,639,051 | 2/1972 | Charlap et al. | 355/3 DD |
| 3,764,208 | 10/1973 | Takahashi et al. | 355/3 DD |

*Primary Examiner*—Werner H. Schroeder
*Assistant Examiner*—Andrew M. Falik

[57] ABSTRACT

Improvements to a matrix supporting device in electrostatic development apparatus, wherein the pliers retaining the matrix rear portion can be moved along a cylindrical surface to which said matrix is intended to adhere. A cam controlled oscillating support provides for a magnetic roller and its associated toner carrying tray to be moved away from the cylindrical surface to allow for passage of the pliers.

3 Claims, 11 Drawing Figures

MATRIX SUPPORTING DEVICES IN ELECTROSTATIC DEVELOPMENT APPARATUS

This invention is concerned with improvements to a device which, as a latent image is electrostatically developed, retains a previously exposed matrix at a correct position.

Electrostatic methods for transferring an original text or the like on a printing matrix are well known, and generally consist of electrostatically charging the matrix, exposing the matrix to form the latent image of the original thereon, developing the image by applying a toner on the matrix, and fixing such a toner or powder by baking, or firing.

According to conventional apparatus, the relating development is carried out by dipping the matrix in a development powder (toner) bed, or by applying such a powder or toner by a magnetic cylinder withdrawing it from a suitable tray. In both cases, the matrix is held along the longitudinal edges by pliers or the like. These approaches have the disadvantage that powder or toner distribution is uneven or not at an optimum rate in the exposed areas, either because of the roughness of the dipping method, or because of the variability in the distance between said magnetic cylinder or roller and matrix, which variability is due to the means (pliers) used in supporting the matrix.

In order to overcome such a disadvantage, we proposed that the matrix should be brought in front of the magnetic powder or toner transferring cylinder or roller while adhering to a rotable cylindrical surface.

However, this approach enables the handling of matrices having a given size and accordingly its range of use will be only limited.

Therefore, it is the object of the present invention to improve the device as above described, so that it can be used with matrices of different or varying size. According to the invention, this is accomplished by providing that the pliers holding the tail or rear portion of the matrix can be moved along the cylindrical surface on which said matrix should adhere.

However, the provision of movable rear pliers would involve an increase in the radial dimensions of the cylindrical surface at that position where said rear pliers are located. This increased overall size prevents said pliers from passing the magnetic powder (toner) transferring cylinder or roller (which should be at a predetermined distance from the matrix) without interferring therewith. In order to overcome this problem, it is proposed according to the present invention that said magnetic cylinder or roller and associated toner-holder tray is supported so that it can be moved away away from the cylindrical surface when the rear pliers are passing or moving opposite thereto.

The invention will be more clearly understood from the following detailed description of a preferred embodiment thereof, as given by mere way of unrestrictive example, and schematically shown in the accompanying drawing, in which.

Figure 1:
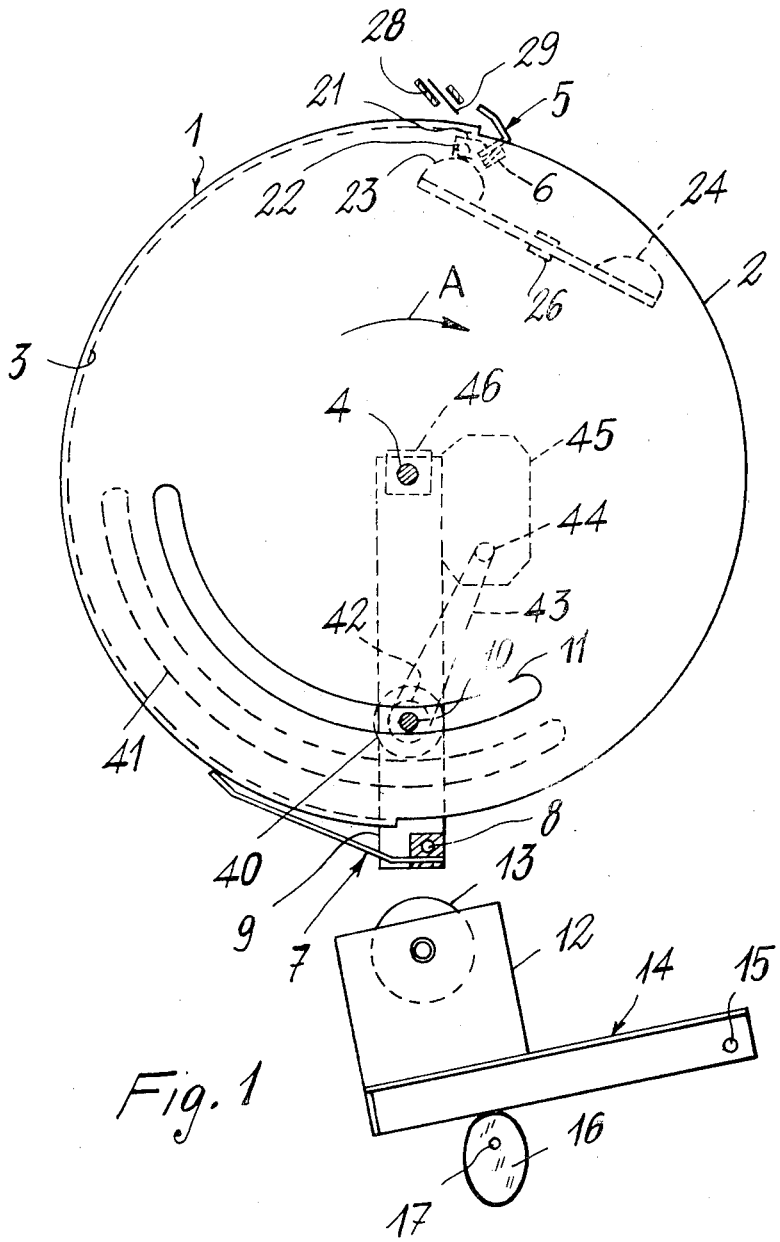
FIG. 1 is a side elevational view showing the matrix supporting device at one position with some parts omitted for the sake of clearness.

Referring to the figures of the accompanying drawings, reference numeral 1 denotes as a whole a body member comprising two circular heads 2 and a substantially semicylindrical skirt or shell 3. Said body member 1 is secured to a shaft 4 operated by a geared motor, not shown.

Front pliers 5 are located at one end of said skirt or shell 3 and are carried by a shaft 6 rotably mounted in said heads 2. A spring, not shown, tends to retain said pliers at closed position.

Rear pliers 7 are rotably carried by a shaft 8 mounted between a pair of arms 9, the latter being idly mounted on said shaft 4 externally of heads 2. A shaft 10 is rotably carried on said arms 9 and passes through apertures or slots having an arc of circle configuration 11 and formed in said heads 2. The rear pliers are also under the action of a spring tending to retain them at closed position. Two pinions 40 are keyed to said shaft 10 and each of these pinions mesh with a sector gear 41 which is attached on the inner side of each head 2. A gear wheel 42 is also keyed to said shaft 10 and is connected by means of a chain 43 with a gear wheel 44 driven by a reversable type of electric motor 45, the latter being carried by a square hollow shaft 46 idly mounted on shaft 4. Owing to this kinematic linkage, when motor 45 is energized (for example through sliding contacts), arms 9 will be moved and hence rear pliers 7 will be moved to or away from front pliers 5, and, as a result, the matrix size being used will be accomodated. A tray 12 is located below body member 1 and contains the development powder or toner. In any known manner, this tray supports a magnetic cylinder or roller 13, the latter applying the development powder or toner to the matrix adhering to said skirt or shell 3 of body member 1.

Said tray 12 and cylinder or roller 13 are carried on a frame member 14, which is hinged at 15 to a stationary part of the machine casing, not shown. Cams 16 carried by an axis or shaft 17 driven by a geared motor, not shown, act upon said frame member. Cams 16 serve the purpose of lifting and lowering said frame member 14 and accordingly said magnetic roller or cylinder 13 (see FIGS. 1 and 2).

Shaft 8 for the rear pliers is provided with a radial arm 18 having a small roller 19. This small roller 19 is intended to cooperate with a stationary cam 20 (see FIG. 2) for opening said rear pliers 7.

Figure 3:
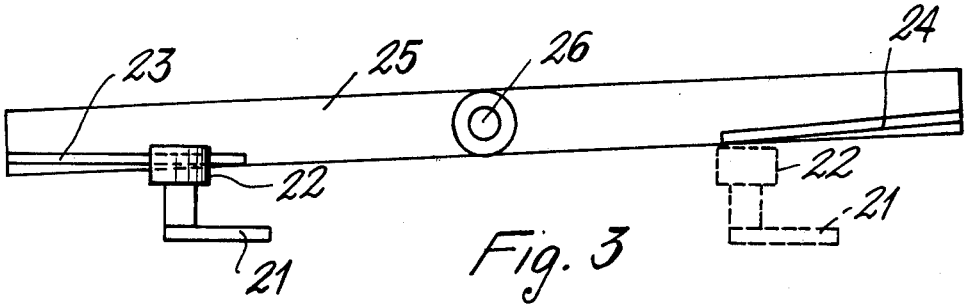
FIGS. 3 and 4 are enlarged plan views showing the movable cams for controlling the front pliers.
Figure 4:
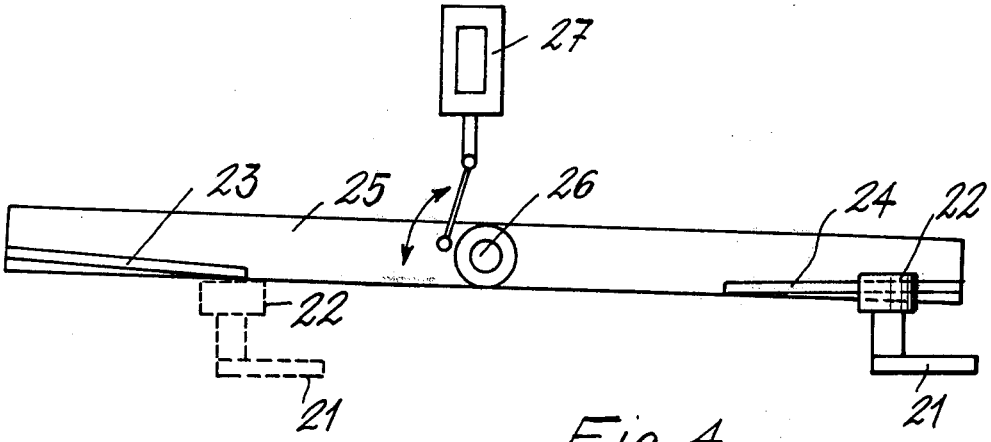

Shaft 6 for front pliers 5 is provided with an extension 21 fitted with a small roller 22. This small roller 22 is intended to cooperate alternately with either cam of a pair of cams 23 and 24 carried on an arm 25 rotably mounted on a stationary axis or shaft 26. Arm 25 can be moved either to the position shown in FIG. 3, or to the position shown in FIG. 4, so that either of said cams 23 and 24 can alternately act upon front pliers 5 to cause the opening thereof. The drive to camholder arm 25 can be given or imparted by an electromagnet 27, the armature of which is under the action of a return spring, not shown. After exposure, a duct or guide 28 carries matrix 29 to body member 1.

The operation of the device according to the invention is as follows.

Figure 2:
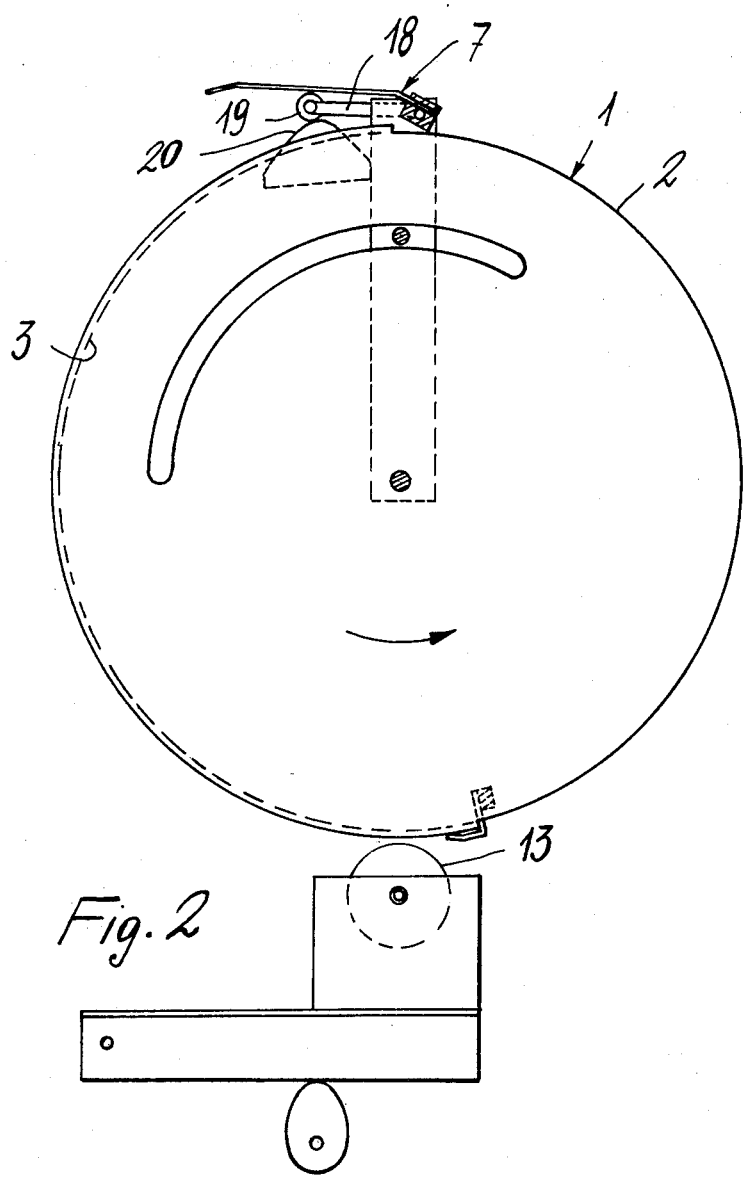
FIG. 2 is a side elevational view (on the opposite side to that of FIG. 1) showing the device at another position with some parts omitted.
Figure 5:
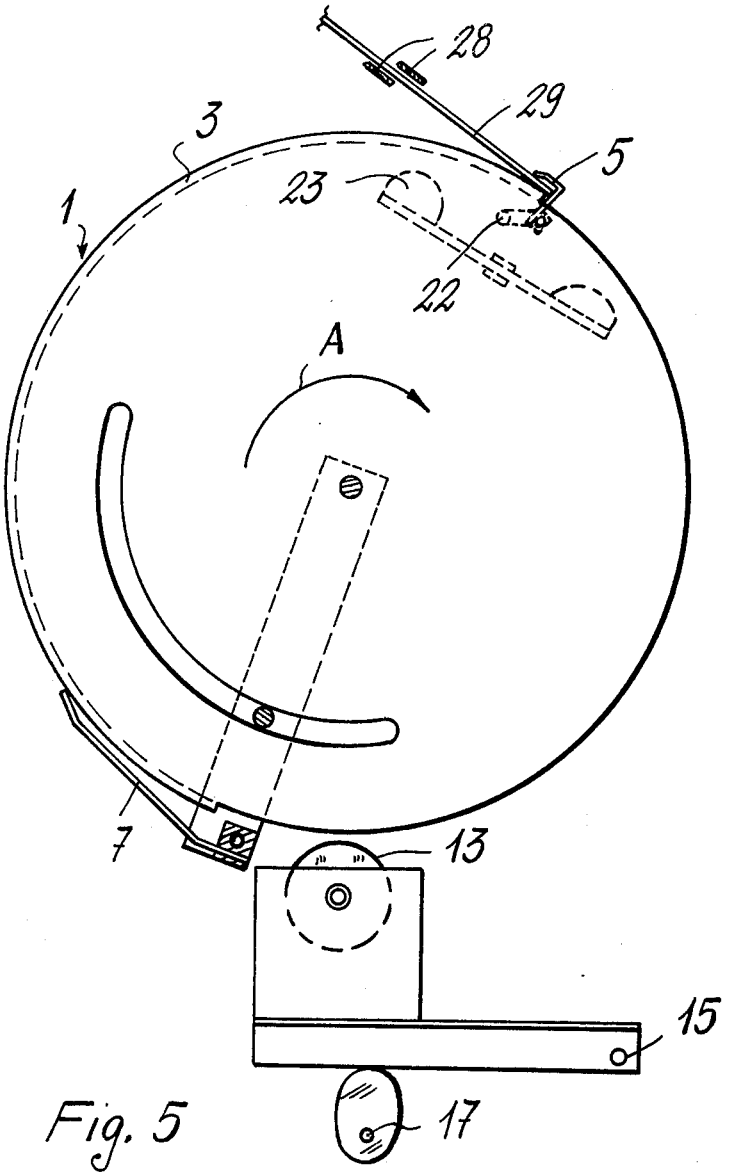
FIGS. 5 through 10 are views similar to FIG. 1 showing the further positions of the device.
Figure 6:
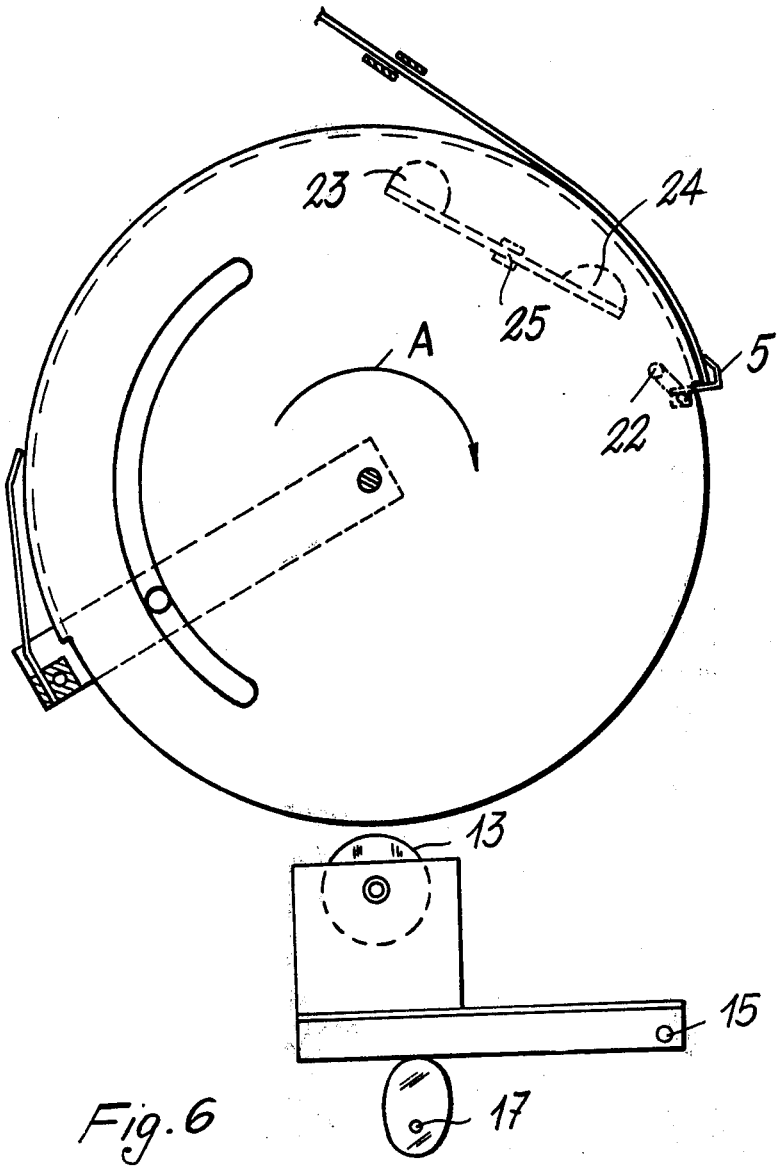

When matrix 29 from exposure moves along said duct or channel 28, it acts upon a microcontact, not shown, and the geared motor controlling body member 1 is operated in the direction of arrow A of FIG. 1, representing the starting position. By passing cam 23, which is interposed in the path of small roller 22, front pliers 5 are closed, clamping the front edge of the matrix on skirt or shell 3 (see FIG. 5). Rear pliers 7 move away from the position of FIG. 1, and, when there is no more any risk of interference with magnetic cylinder or roller 13, such pliers act upon a microcontact, not shown, causing the operation of shaft 17 and accordingly an upward displacement of magnetic cylinder or roller 13, the latter taking the position of FIG. 5, where it stops. When front pliers 5 have passed rocking arm 25 (see FIG. 6), they will act upon a microcontact causing the energization of electromagnet 27. Thereby, said rocking arm 25 moves from the position of FIG. 3 to that of FIG. 4, moving cam 23 away from the path of small roller 22 and presetting cam 24 in said path.

Figure 7:
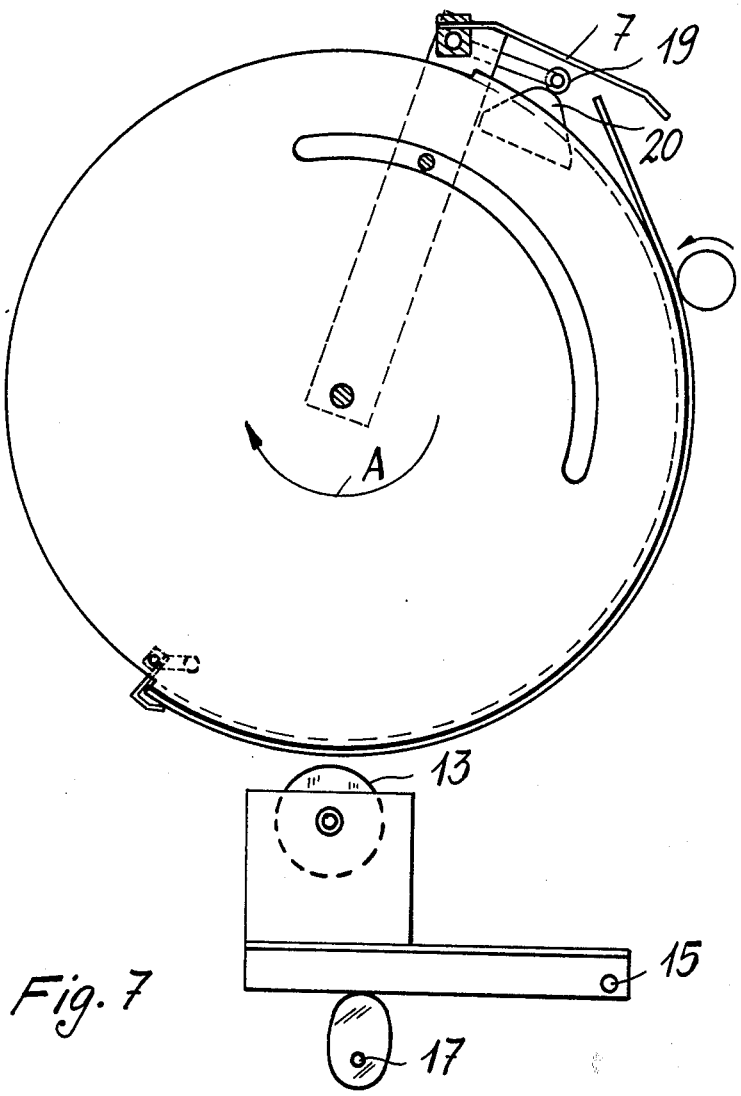

At some time, rear pliers 7 (see FIGS. 2 or 7) open, since small roller 19 thereof interfers with cam 20. Then, rear pliers 7 close and clamp the tail or rear portion of the matrix which is maintained adherent to skirt or shell 3 by resiliently yieldable rollers, not shown.

Figure 8:
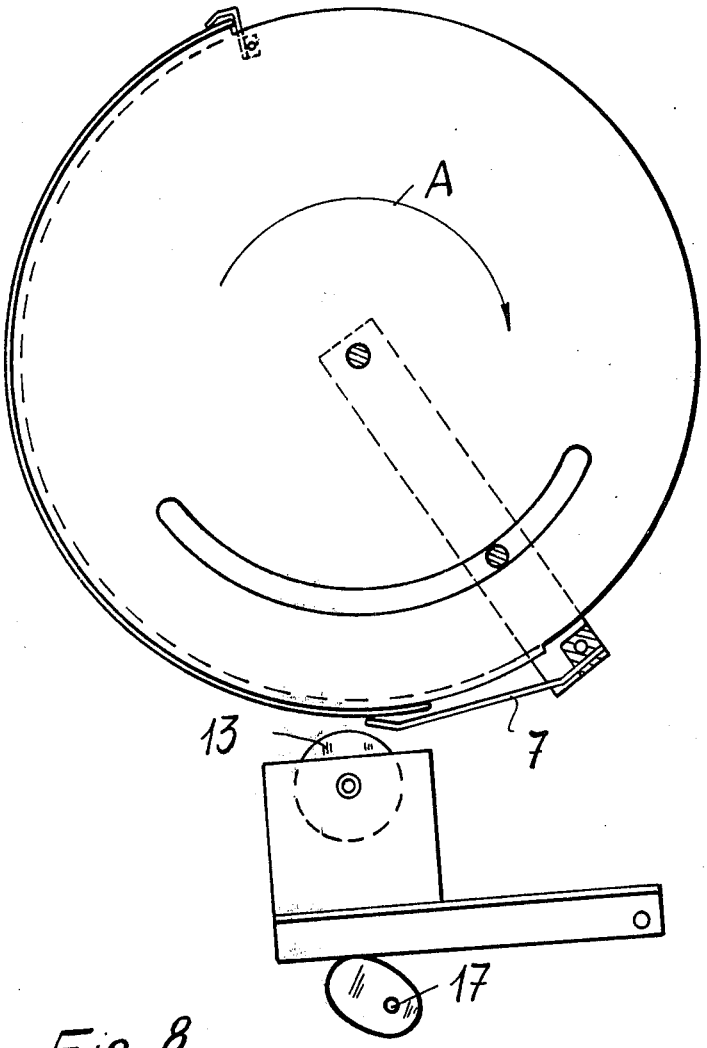
Figure 9:
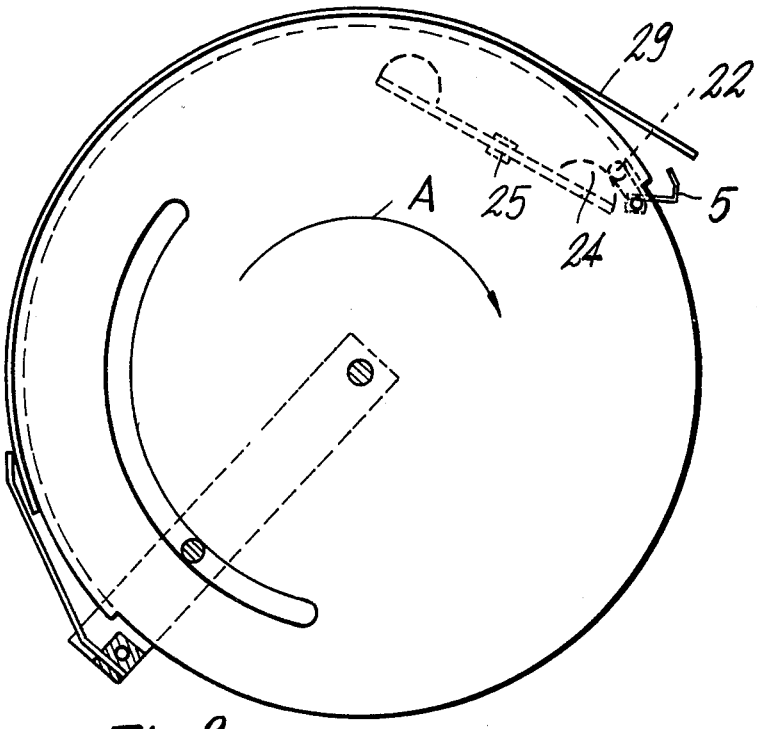
Figure 10:
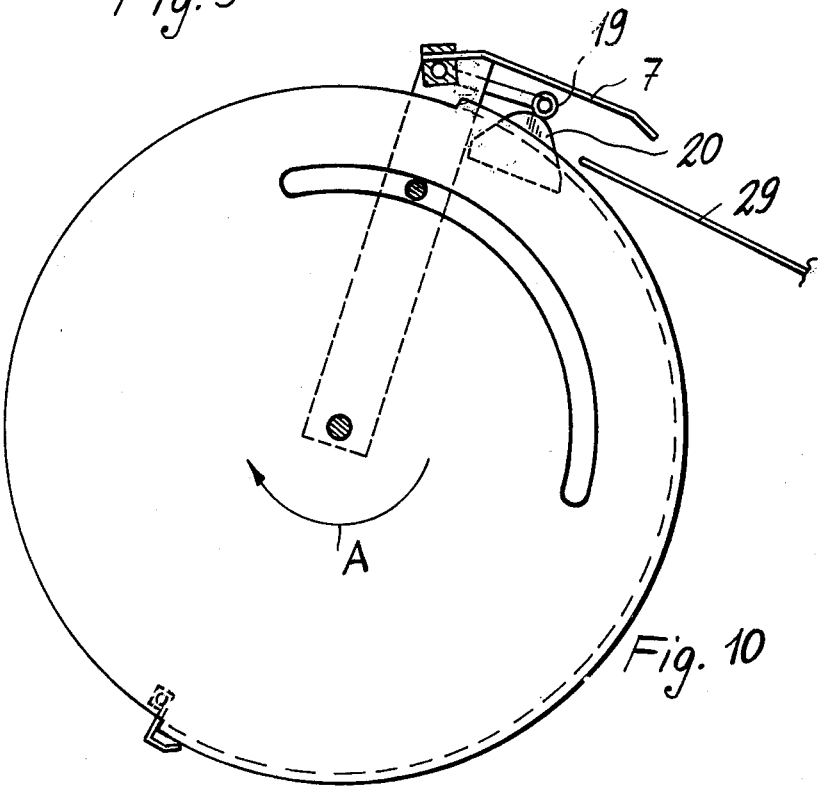
Figure 11:
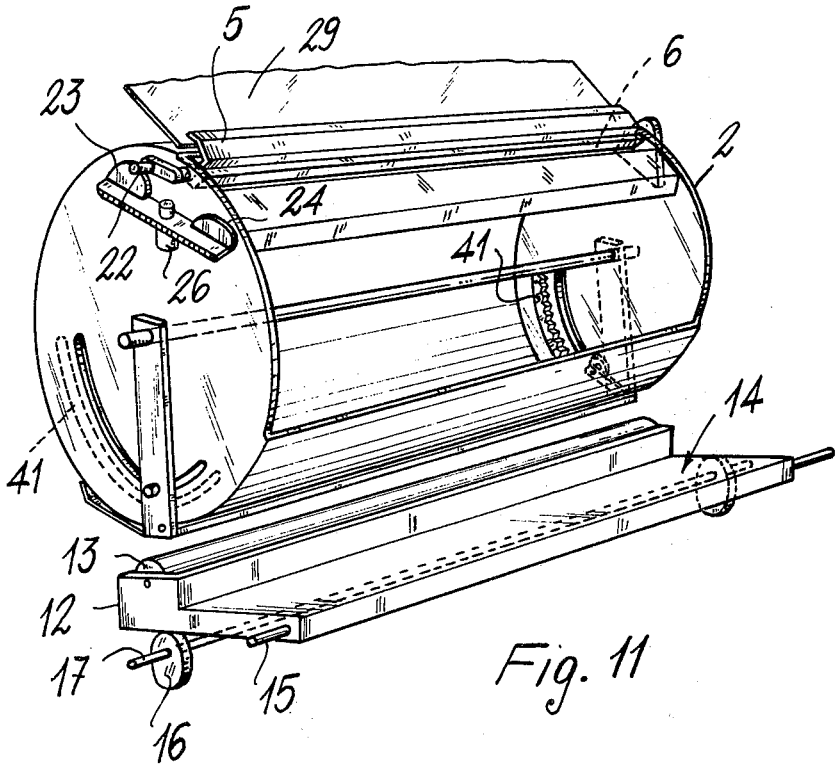
FIG. 11 is a perspective view of the device according to the present invention.

When arriving in proximity of magnetic cylinder or roller 13, (see FIG. 8) said rear pliers 7 act upon a microncontact causing axis or shaft 17 to rotate, with a resulting lowering of said magnetic cylinder or roller, which accordingly does not interfere with rear pliers 7. Arriving then on cam 24 (see FIG. 4), said front pliers 5 are opened and release the matrix which remains at blocked condition only on its tail or rear portion (see FIG. 9). Rear pliers 7 arrive at cam 20 (see FIG. 10), thus opening and leaving the matrix which is collected on a chute or the like and is moved to firing. At this position, the operation of the rear pliers on a microcontact will de-energize said electromagnet 27, moving rocking arm 25 back to the position of FIG. 3.

The movement of body member 1 is stopped on reaching the position of FIG. 1 through the operation of a limit switch de-energizing the motor.

What is claimed is:

1. Improvements in matrix supporting devices for use in electrostatic development apparatus having a cylindrical surface to which a matrix sheet is to adhere, pliers for retaining a rear portion of the matrix sheet, a magnetic cylinder or roller, and associated toner containing tray, said improvements comprising:

means for moving said pliers along said cylindrical surface; and carrying means supporting said magnetic cylinder or roller and associated toner containing tray, such that said cylinder or roller and said tray are moved away from said cylindrical surface to allow passage of said pliers.

2. The improvements as claimed in claim 1, wherein said carrying means includes a cam-controlled oscillating support.

3. The improvements as claimed in claim 6, wherein said means for moving said pliers along said cylindrical surface includes:

a motor spaced from and mounted for rotation about the longitudinal central axis of said cylindrical surface;

a shaft connected for rotation by said motor;

a support means supporting said shaft and said pliers for movement about said axis;

gear means on said shaft; and sector gears disposed at opposite ends of said cylindrical surface and engaging said gear means;

whereby activation of said motor causes movement of said shaft with respect to said sector gears and corresponding movement of said pliers with respect to said cylindrical surface.

* * * * *